United States Patent [19]

Zaniewski

[11] 4,142,457

[45] Mar. 6, 1979

[54] LOST MOLD FOR THE CASTING OF A MOUTHPIECE OR NOZZLE FOR A CHIMNEY OR SMOKESTACK

[76] Inventor: Michel H. Zaniewski, Ave. Ferdinand de Lesseps, Frontignan, France, 34110

[21] Appl. No.: 797,174

[22] Filed: May 16, 1977

[30] Foreign Application Priority Data

May 21, 1976 [FR] France ..... 76 15872

[51] Int. Cl.[2] ..... F23L 17/02

[52] U.S. Cl. ..... 98/58; 52/244

[58] Field of Search ..... 249/DIG. 1; 52/19–21, 52/244; 98/58, 83, 67, 78

[56] References Cited

U.S. PATENT DOCUMENTS

| | | | |
|---|---|---|---|
| 405,667 | 6/1889 | Hinkley | 52/244 |
| 2,135,342 | 11/1938 | Jackson | 249/DIG. 1 X |
| 2,646,743 | 7/1953 | Van Alstyne | 98/67 X |
| 2,660,105 | 11/1953 | Sabin, Jr. | 52/244 X |
| 2,680,402 | 6/1954 | Adelt | 52/244 X |
| 3,183,822 | 5/1965 | Stone et al. | 98/67 X |
| 3,262,668 | 7/1966 | Luker | 249/DIG. 1 X |
| 3,399,858 | 9/1968 | Luker | 249/DIG. 1 X |
| 3,610,135 | 10/1971 | Sheridan | 249/DIG. 1 X |

*Primary Examiner*—William E. Wayner
*Assistant Examiner*—William E. Tapolcai, Jr.
*Attorney, Agent, or Firm*—Karl F. Ross

[57] ABSTRACT

A lost mold for the casting of the ferrule, nozzle or mouthpiece of a chimney or smokestack consists of a light-weight relatively thin material which can burn off, wear or degrade in use and which is stabilized in a casting chest or box with sand for the casting of the concrete body adapted to form the ferrule or mouthpiece. The lost mold permits the casting of a draw-promoting device for a chimney by masons at the site of erection tnereof and hence eliminates the need to transport massive bodies long distances. It also eliminates difficulties encountered with the shaping of the mouth of a smokestack or chimney by masons or chimney specialists.

9 Claims, 3 Drawing Figures

LOST MOLD FOR THE CASTING OF A MOUTHPIECE OR NOZZLE FOR A CHIMNEY OR SMOKESTACK

FIELD OF THE INVENTION

The present invention relates to a lost mold for the casting of a ferrule, mouthpiece or nozzle of a chimney or smokestack, to a method of making a mouthpiece or similar device, and to the mouthpiece thus made. More particularly, the invention relates to the construction of nozzles or mouthpieces for chimneys and smokestacks in which the structural material of the body is concrete but the body has an intricate shape.

BACKGROUND OF THE INVENTION

It is known to shape the mouth of a chimney or smokestack or to provide the latter with a static device for increasing the draw of the chimney and for suppressing backflow of gases downwardly therethrough. Such devices are generally made from metal, ceramic, or concrete and are usually manufactured in a factory and transported in a finished state to the erection site at which they are placed upon the chimney.

While metal structures of this type are relatively simple to fabricate, they are highly sensitive to oxidation, particularly in the presence of sulfurous gases which are formed during combustion of the fuel. In practice, such devices are only installed by specialists, i.e. so-called chimney specialists, especially trained to mount the device on the chimney and to construct the device.

It has also been proposed to shape the mouthpiece of a chimney or smokestack in situ and, to this end, the construction of the mouth of the chimney may be carried out by masons during the erection of the chimney. However, such chimney-mouth configurations have been found to be less than satisfactory with respect to increasing the draw of the chimney and, because the device is fabricated in situ, it generally has poor aerodynamic qualities and does not provide optimum results with respect to combustion. Finally, in this regard, the in situ formation of the mouthpiece configuration requires skilled personnel, is time-consuming and is expensive.

It has also been proposed to provide draw-promoting devices which are fabricated from cement and are generally produced in factories or the like and transported to the site at considerable cost. Furthermore, these devices are highly fragile and, because they are heavy and difficult to manipulate, are prone to damage. Frequently, therefore, a unit of this type transported to the erection site is found to be defective because of some damage resulting from its fragile character and its weight. The device must be replaced, i.e. another unit must be shipped. This holds up erection of the factory or other structure provided with the chimney.

OBJECTS OF THE INVENTION

It is the principal object of the present invention to provide a lost mold for the casting of a draw-promoting device for the purposes described, from concrete or mortar, which obviates the disadvantages of the earlier systems.

It is another object of this invention to provide an improved draw-promoting or draw-controlling nozzle, mouthpiece of ferrule for the top of a smokestack or chimney which is not prone to damage, can be fabricated simply and conveniently, can be made and erected at the chimney site, and which has optimum aerodynamic properties.

Still another object of the invention is to provide a system for increasing the draw or draft of a chimney or smokestack can be manufactured by unskilled or semi-skilled personnel and which can be erected with ease upon the mouth of the chimney.

Still another object of the invention is a method of making a chimney mouthpiece for the purpose described.

SUMMARY OF THE INVENTION

These objects and others which will become apparent hereinafter are attained by providing a thin-walled light-weight lost mold which can be supported in a casting box or chest on a bed of sand or other pulverulant material and into which concrete or mortar can be cast, the lost mold remaining in place upon the hardened body when the latter is mounted upon the mouth of the chimney. In other words, the draw-promoting device of the present invention can be fabricated directly at the chimney site by masons who are not particularly adept at the design and erection of chimney mouthpieces, from simple concrete or mortar, i.e. materials which are normally present at a construction site. Because the lost mold is the only factory-produced item which must be transported to the construction site, the transportation costs and handling procedures and greatly simplified. All that is necessary is for the mason to fill the mold with a hardenable material (usually concrete) and permit hardening of the device. The resulting structure includes the hardened concrete body and internal and external covering formed by the lost mold. The term "lost mold" as used herein is intended to indicate any mold structure that is retained upon the body cast therein. According to a feature of the invention, the device itself is relatively light which facilitates working on the roof. Even the casting can be carried out without a specialist.

According to another feature of the invention, the draw-promoting device comprises a plurality of parts, including a nozzle structure which has an upwardly convergent passage and an upwardly convergent outer periphery, a generally planar cap which overlies the nozzle, and a plurality of posts angularly spaced about the nozzle and supporting the cap. The cap may itself be formed in two parts, namely with an annular member having a convex surface aligned with and confronting the mouth of the nozzle, and a plug received in the central orifice of this cup. The cap, the plug, the post and the nozzle are advantageously all cast from concrete at the chimney site using the lost-mold technique described above.

According to a feature of the invention, one of the parts of the lost mold, i.e. the part for forming the nozzle, comprises a rigid and light envelope constituted by two coaxial frustocones. The exterior frustocone has an upward convergence and comprises at its base two broad and deep circular lobes (toroidally segmented recesses) parallel to this base. At its top, the exterior cone is formed with a plurality of lobes (toroid segments) of small radius of curvature parallel to its small base. The small base is provided with a rounded crest and a set-back rim in the form of a frustocone widening upwardly to provide in the region of the mouth of the nozzle a Venturi collar or neck accelerating the gases uwpardly. The interior frustocone, which forms the second piece of this element, diverges downwardly (converges upwardly) and terminates at its upper end in a cylindrical sleeve which receives the downwardly extending exterior piece forming the Venturi throat. At its lower end, the interior frustocone is provided with a cylindrical sleeve or a prismatic sleeve, depending upon the shape of the chimney, and receiving snugly the upper end thereof.

According to still another feature of the invention, the rigid light-weight element formed as a lost mold for the cap of the device is constituted by two upwardly open complementary cups, the first forming the generally planar disk of the cap, while the other forms the plug for the central opening in the first. The plug, which has an overhanging lip upon which it rests under its weight, can be simply withdrawn to permit cleaning of the chimney.

More particularly, the first lost mold of the cap has the configuration of a conical plate converging toward the bottom and of very low conicity. This member is provided with a coping at its lower periphery and a cylindrical upstanding flange at its center adapted to receive the second lost mold of the cap which has the configuration of a plug. The latter is also constituted with a cylindrical sleeve and is provided at its bottom as a cone which continues the convergence of the conical surface of the aforementioned plate. As a consequence, the cap has a substantially continuous conicity, i.e. widens upwardly and outwardly. At its upper end, the cylindrical plug can be formed with the aforementioned flange or rim which advantageously is provided with a groove receiving the upper end of the cylindrical flange of the plate.

According to still another feature of the invention, the cap is provided at its lowest central point, i.e. its vertex, with an aileron or plate parallel to the horizontal and hence to the plane of the plate and fixed in the center of the body forming the plug, this aileron being a circular disk having a diameter less than the diameter of the plug and less than the diameter of the mouth of the Venturi throat.

Yet another feature of the invention resides in forming the connection between the cap and the nozzle and statically securing the assembly together as a plurality of cylindrical posts peripherally spaced around the device. The separation between these two elements is such that surface of the imaginary frustocone having its large base formed by constriction at the mouth of the chimney and as its small base the aforementioned aileron or disk is at least equal to the flow cross sections of the Venturi throat.

Each of the posts can be formed from a lost mold constituted by a cylindrical or polygonal tube and filled with concrete or mortar through which a metal tie rod extends to connect the two parts of the device, namely, the cap and the nozzle. The tie rod can extend through a further tube extending coaxially within each post and also composed of the light-weight material forming the lost molds. Advantageously, the cap and the nozzle can each be formed with a socket receiving the respective post and provided with a tubular boss through which the tie rod extends.

The material from which the lost molds are constituted is advantageously a material which upon thermal decomposition or combustion does not produce any toxic or environmentally polluting degradation products. It can consists of a blow-molded plastic pressed metal foil. It can also be a thin foil of asbestos cement. Good results have been attained with cellulosic-fiber lost molds, e.g. pressed cellulosic fiber or paper-type fiber molds. It has been found to be advantageous to package the lost mold in a cardboard box and ship it therein to the molding and chimney-erection site, the box serving as the chest which can be filled with sand to support the mold during the casting of concrete or mortar therein.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
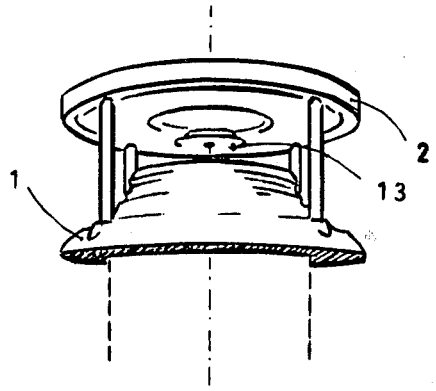
FIG. 3 is a perspective view showing the assembly atop a chimney.

All of the views of the drawing are diagrammatic in the sense that the wall thickness of the lost molds has been shown to be greatly enlarged relative to the dimensions of the remaining portions of the structure.

In the drawing I have shown the main mold I adapted to form the principal nozzle body at the head of the chimney, the mold 2 adapted to form the cap which covers the head of the chimney, the mold 3 for producing the plug in this cap which is removable to permit cleaning of the chimney, and the tubular molds 4 for producing the posts supporting the cap upon the nozzle body.

Each of these lost molds is made from a light-weight material which should be decomposable without polluting the environment. Best results are obtained with thin foils of blown synthetic resins or synthetic-resin foils given the shapes shown by some other process. They can be made of thin asbestos cement foils. Advantageously, however, they are fabricated from a compressed cellulose or other fibrous material of similar type. In each of these cases, the mold structure can deteriorate under environmental effects without endangering the environment, leaving the respective mortar or concrete bodies which are shaped by the molds and retain their configuration in spite of the progressive disappearance of the lost molds.

Figure 1:
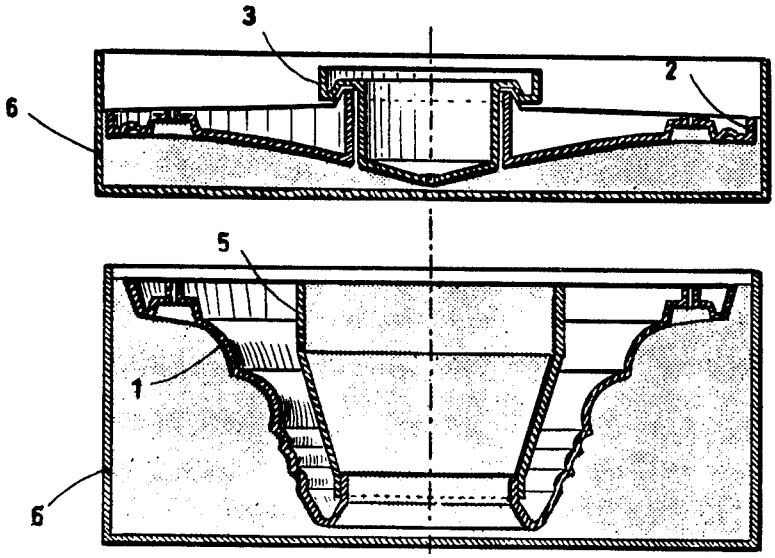
FIG. 1 is a vertical cross-sectional view through the main molds for producing a device adapted to be mounted on the top of a chimney.

The principal mold is formed from an external frustocone 1 and an internal frustocone 5 received in the external frustocone 1 as best shown in FIG. 1. This permits each of the parts of the principal mold to be removed from the conical forms upon which they are made with ease.

Figure 2:
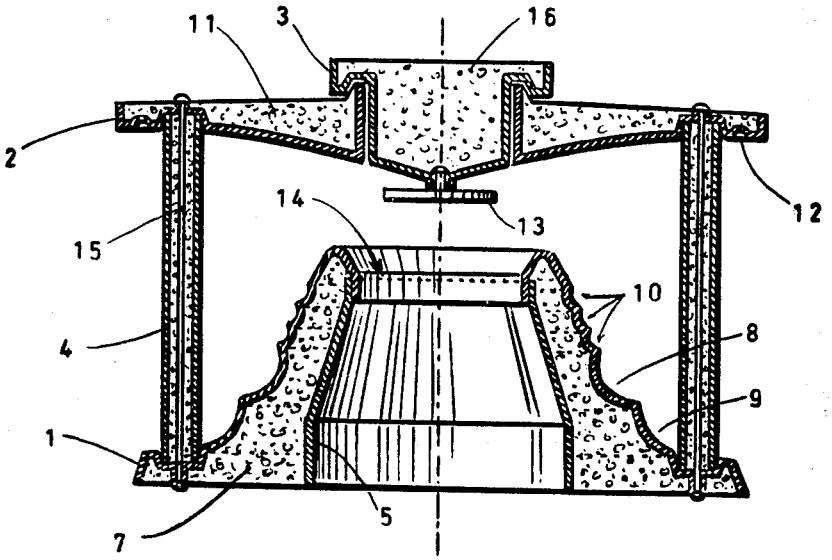
FIG. 2 is a vertical section through the device.

The molds thus are of light-weight and can be transported readily to the chimney-erection site, e.g. in a cardboard box 6. This box, which can be filled with sand to support the mold, permits casting of the concrete or mortar into the mold cavities formed between members 1 and 5. The sand supports the mold walls against deformation during the casting process. After hardening of the mortar, the body, consisting of the members 1 and 5 and the mass of concrete 7 can be erected upon the chimney as shown in FIGS. 2 and 3. For mounting upon the chimney, the nozzle body is inverted and the lower cylindrical sleeve portion of member 5 is placed upon the upper end of the chimney which is received therein.

The configuration of the device is selected to obtain the best drawing of gases through the chimney using the static elements described. To this end, the lower portion of the external frustocone is formed with outwardly concave circular recesses 8 and 9 of relatively large radius of curvature, i.e. toroidal segments, which are disposed close to the base of the concrete body 7. These toroidal segments promote a lamina flow of air across the top of the nozzle body and surpress turbulence. At its upper end, the inner frustoconical member 5 receives the inwardly converging or outwardly divering and inwardly turned Venturi neck 14 so that the passage for the gases is biconical to prevent backflow gases.

The lost mold 2 which is used to produce the cap 11 in a similar manner is likewise supported by sand in its box 6. The member 11 has a peripheral coping 12 and a large central opening adapted to receive a plug 16, similarly cast in place, formed by mold 3 and which is removable to permit cleaning of the chimney without dismounting the remainder of the device. The chimney has been shown in broken lines in FIG. 3.

The upper surface of the cap 11 is cast with an inclination toward the exterior.

The plug 16 which blocks the central opening of the cap, has a laterally extending flange provided with a downwardly open groove receiving an upstanding sleeve of the mold 2 as illustrated in FIGS. 1 and 2.

The lower surface of the cap, including its plug, is slightly conical with an apex at the axis of the device.

At this apex, the plug 16 carries a plate (aileron) 13 which can be slightly elongated by a crossbar, this plate having a diameter less than that of the Venturi throat 14 at the top of the chimney. This conical configuration of the lower surface of the cap ensures an acceleration of the gases discharged from the chimney. Furthermore, the plate 13 ensures lamina flow of this gaseous discharge.

At its upper portion, the external frustocone 1 is provided with toroidal segments 10 of small radius of curvature. As a result, laterally moving air engaging the body 7 is diverted and accelerated away from the Venturi throat 14 in a lamina flow which is accelerated by the shape of the cap as well. As a result a maximum suction force or draft is developed at the head of the chimney.

The cap 11 is fixed rigidly with the nozzle 7 and is spaced therefrom by posts which are cast in the tubular molds 4 and are traversed by tie rods or bolts 15 put in place before the casting of the mortar. A nut may then be threaded onto the upper and lower ends of each of the tie rods when the device is assembled as shown in FIG. 1. The tie rods 15 pass through tubular bosses extending from sockets in the nozzle 7 and the cap 11 accommodating the posts. These sockets may have the configuration of circular cups.

The spacing of the cap 11 from the nozzle 7 is such that the free passage defined by the imaginary frustocone between the opening at the upper end of the nozzle and the aileron 13 is equal to the flow cross-section of the Venturi throat 14.

The device illustrated and described can be cast at the chimney-erection site using the usual materials, e.g. moldee or concrete and sand available there. It is simply required to open the packing carton, position the molds as shown in beds of construction sand and pour the concrete. After hardening, the nozzle member can be mounted upon the top of the chimney so that the upper end of the chimney is snugly received in the cylindrical or prismatic portion of the inner member 5, the cap 11 being then mounted upon the posts and the nuts of the tie rods 15 tightened. The device retains its structural integrity even upon deterioration of the lost molds which form coverings or sheaths for the concrete member until these lost molds deteriorate.

I claim:

1. A lost mold for a chimney draw-promoting device comprising:

a lightweight thin-wall envelope formed with an inner generally frustoconical member and an outer general frustoconical member, said envelope being adapted to receive a hardenable material and to remain on said material and form a nozzle body of the device subsequent to the hardening of such material;

a second envelope adapted to receive said hardenable material to form a cap of said device and composed of thin lightweight material; and a plurality of tubular envelopes of thin lightweight material adapted to receive said hardenable material for the casting of posts therein for connecting said cap to said body.

2. The lost mold defined in claim 1 wherein said inner generally frustoconical member is formed with a lower portion adapted to receive the upper end of said chimney and a cylindrical upper portion, said outer member being provided with a broad base at its lower end and converging toward its upper end, said upper end of said outer member being formed with an inwardly extending rim received in said cylindrical portion of said inner member and defining a Venturi throat therewith, said outer member being formed proximal to said base with a plurality of toroidal-segmental concavities of large radius of curvature and proximal to said rim with a plurality of toroidal-segmental concavities of small radius of curvature.

3. The lost mold defined in claim 2 wherein said second envelope comprises a generally flat member having a central opening and a plug-shaped member receivable in the opening and removable therefrom, said member of said second envelope defining a continuous shallow cone.

4. The lost mold defined in claim 3 wherein said base and said flat member of said second envelope are each formed with cup-shaped recesses receiving said posts.

5. A kit consisting of the envelopes defined in claim 1 in at least one cardboard box adapted to form a casting chest for pouring concrete into said lost molds.

6. A draw-promoting device for a chimney comprising:

a nozzle body of hardened material case in a lost mold of thin lightweight material forming a covering for said hardened material, said body having a frustoconical passage converging upwardly and provided with a portion at its lower end receiving the upper end of said chimney and a cylindrical portion at its upper end, said body having a frustoconical outer configuration converging upwardly from a broad base and terminating at its upper end in an inwardly turned rim, said passage forming a Venturi throat adjacent said rim;

a cap spaced above said rim and consisting of a generally flat substantially circular body of downwardly converging shallow conicity coaxial with said nozzle body, generally said flat body being formed with a central opening receiving a generally cylindrical plug defining the vertex of the cone of the underside of said generally flat body, said cap being cast of hardened material in a lost mold having said shallow conicity and a cylindrical portion defining said plug, said plug being removable to afford access to the chimney; and a plurality of posts connecting said cap with said nozzle body, said posts each comprising a tubular lost mold receiving the mass of hardened material and having a tie rod embedded therein and connected to said cap and said nozzle body.

7. The device defined in claim 6 wherein said lost molds are each composed of a material selected from the group which consists of synthetic-resin foils, pressed metal foil, asbestos cement and cellulosic material.

8. The device defined in claim 7 wherein said hardened material is concrete.

9. The device defined in claim 8 wherein said plug is formed with a disk at said vertex lying perpendicular to said access and constituting an aileron, said aileron having a diameter less than the diameter of said Venturi throat.

* * * * *